United States Patent [19]

Banyasz

[11] 4,333,482

[45] Jun. 8, 1982

[54] PROCESS FOR INCREASING FILLING POWER OF RECONSTITUTED TOBACCO

[75] Inventor: Joseph L. Banyasz, Richmond, Va.

[73] Assignee: Philip Morris Incorporated, New York, N.Y.

[21] Appl. No.: 171,173

[22] Filed: Jul. 22, 1980

[51] Int. Cl.[3] ..... A24B 3/14; A24B 3/18

[52] U.S. Cl. ..... 131/300; 131/353; 131/357; 131/370; 131/374; 131/903; 131/303

[58] Field of Search ..... 131/903, 291, 292, 296, 131/353, 357, 358, 370, 359, 300, 374, 301–307

[56] References Cited

U.S. PATENT DOCUMENTS

| | | | |
|---|---|---|---|
| 2,596,183 | 5/1952 | Sowa | 131/292 |
| 2,656,841 | 10/1953 | Gurley, Jr. | 131/140 |
| 3,194,245 | 7/1965 | Clarke | 131/140 |
| 3,223,090 | 12/1965 | Strubel et al. | 131/292 |
| 3,431,915 | 3/1969 | Licis | 131/140 |
| 4,040,431 | 8/1977 | Ashworth et al. | 131/296 |
| 4,161,953 | 7/1979 | Glock | 131/292 |

OTHER PUBLICATIONS

*Tobacco and Tobacco Smoke* by Wynder et al., Academic Press, New York and London, 1967, pp. 57 and 58.

*Primary Examiner*—V. Millin
*Attorney, Agent, or Firm*—Robert M. Shaw

[57] ABSTRACT

A method for increasing the filling power of sheet or shredded reconstituted tobacco which is normally not susceptible to conventional expansion techniques is provided. In the practice of the method reconstituted tobacco having a uniform moisture content of 15–50 weight percent is heated to a temperature above about 90° C. for a period of time beyond that required to drive off substantially all moisture and then is reordered. Heating may be effected in a convection or microwave oven or a drying tower. By means of the method, the tobacco is stiffened whereby a substantially irreversible filling power increase is effected.

18 Claims, No Drawings

PROCESS FOR INCREASING FILLING POWER OF RECONSTITUTED TOBACCO

BACKGROUND OF THE INVENTION (a) Field of the Invention

This invention relates to a means for increasing the filling power of reconstituted tobacco by stiffening the tobacco by application of heat.

(b) State of the Art

Increasing the filling power of tobacco has long been recognized as desirable. To this end many processes have been suggested in the art.

Commonly, such processes involve subjecting tobacco to expansion treatments to increase its filling power. In such treatments the density of the tobacco is reduced and its filling power increased as a result of cell or pocket formation upon volatilization of a material trapped within the tobacco.

According to the expansion process described in U.S. Pat. No. 2,656,841, a cast film of gelantinized tobacco particles having a moisture content between 2 to 65%, is subjected to an intense heat such that the temperature of the film material is raised to 250°-450° F., most preferably 325°-350° F. The heat treatment may range from 0.1 to 5 seconds depending on the thickness of the film and its moisture content. As a result of this heat treatment the moisture becomes steam and pops or blisters the surface of the film, thereby forming pockets and reducing the density of the material.

Expansion processes of the above types are limited to tobacco forms in which the volatile materials can be confined so that their escape effects rupturing of the tobacco materials. However, reconstituted tobacco formed by conventional paper-making techniques, particularly that made without binder, generally lacks the structural integrity required to effect expansion according to such processes.

Reconstituted tobacco is commonly produced by forming a composition containing finely divided tobacco particles and a liquid, usually water, and drying the product, usually by heating. One common method of increasing the filling power of such reconstituted tobacco has been through foaming, as for example by introducing air into the slurry of tobacco parts before the forming step. This can give a significantly less dense product but one that is fragile and subject to breakage in further processing. The foaming operation is critical since the foam is subject to collapse and special equipment is required.

In U.S. Pat. No. 3,431,915 the filling power of reconstituted sheet is improved by stretching separated zones of sheet for a "creped" effect.

U.S. Pat. No. 3,194,245 describes a process for drying a cast sheet of a tobacco slurry containing 3-8% solids whereby the resulting reconstituted tobacco material has increased tensile strength and density. According to the method, the cast sheet is heated to 100° C. to drive off the free water and thereafter to 120°-160° C.

It has now been discovered that by careful control of moisture content of reconstituted tobacco formed by conventional paper-making techniques, it is possible to substantially irreversibly increase its filling power by heat treatment for periods of time in excess of those required for simple moisture vaporization. The increase in filling power is effected by stiffening of the tobacco, rather than by cell or pocket formation.

SUMMARY OF THE INVENTION

The present invention provides a method for increasing the filling power of reconstituted tobacco, which lacks the structural integrity required for expansion processes. In accordance with the invention the moisture content of reconstituted tobacco is uniformly adjusted to between 15-50% by weight, as by spraying and bulking; stiffening the moisture adjusted tobacco by subjecting it to a heat source for a period of time in excess of that required to accomplish evaporation of substantially all of the moisture in the tobacco; and reordering the heat treated tobacco to standard conditions. Where the heat source is a convection oven, heat treatment may be effected on tobacco having a moisture content between 20-50% and preferably 40% by weight at 120°-150° C. for 8-24 hours. In a drying tower, heat treatment may be accomplished on tobacco having a moisture content between 15-30% and preferably 25% by weight in 5 seconds at 500° to 600° C. using an air or preferably an unsaturated steam atmosphere.

DETAILED DESCRIPTION OF THE INVENTION

In accordance with the invention a process is provided for stiffening reconstituted tobacco by application of heat, thereby increasing its filling power. By means of the process it is possible to increase the filling power of reconstituted tobacco material which is not readily susceptible to expansion processes which commonly depend on the structural integrity of the tobacco material to confine a volatile material sufficiently to cause puffing of the tobacco material.

The process of the invention comprises uniformly adjusting the moisture content of reconstituted tobacco material to 15-50% by weight; subjecting the moisturized tobacco to heat for a period of time sufficient to evaporate substantially all of the moisture and continuing the heat treatment for a further period of time whereby stiffening of the tobacco occurs; and thereafter reordering the stiffened tobacco to an acceptable OV level. Heat treatment is effected by any suitable means such as a convection oven, a drying tower or a microwave oven. The time required for the treatment depends on the temperature of the treatment and the moistness of the tobacco material being treated.

More specifically, the process of the invention is applicable to reconstituted tobacco made according to conventional paper making type processes. Further, the process is applicable to reconstituted tobacco which contains no binder. Specifically, reconstituted tobacco such as that made by the processes of U.S. Pat. No. 3,415,253 or Canadian Patent No. 862,497 may be employed. Moreover, the process has application to tobacco material which is shredded or is in sheet form.

The moisture content of the reconstituted tobacco must be uniform and within the range of 15-50% by weight for purposes of the present process. Therefore, the moisture content of the starting material is first uniformly adjusted to this range by suitable means. For this purpose, a water spray may be employed followed by a bulking stage so as to effect uniform water impregnation. A warm water spray will effect more rapid impregnation. Moisture contents above about 50% should be avoided since leaching effects may be observed during drying and above this level the reconstituted material lacks sufficient cohesiveness.

Following moisture adjustment, the reconstituted tobacco material is subjected to a heat treatment to stiffen it. This treatment typically is sufficient to raise the temperature of the tobacco to at least 90° C. and preferably at least 120° C. and always constitutes positive heat imposition sufficient to remove substantially all moisture from the tobacco. The treatment is continued for a period in excess of that required to effect substantially complete moisture evaporation; that is, until stiffening occurs. Generally, a reduction of the OV value to 4%, preferably 3% and most preferably at least to 2% is achieved during the heat treatment process.

The heat treatment may be accomplished using conventional means, as a circulating oven, a drying tower, a microwave oven or infrared irradiation. This heat step may take place in any conventional atmosphere, such as inert gas, air or superheated unsaturated steam. Heat conditions which are severe enough to cause charring of the tobacco should be avoided or special precautions taken to prevent damage.

Forced draft air heating in a convection oven has been found a suitable means for effecting the heat treatment. When such an oven is employed, temperatures of 90°-150° C., preferably at least 120° C., are employed for a period of 8-24 hours. With this heating method, optimal filling power increases are achieved when material having a relatively high moisture content, such as 40% by weight, is employed. However, material having moisture contents between 20-50% by weight can be employed in this heat treatment with significant filling power increases being achieved.

A drying tower has been found to be a particularly effective means for accomplishing the heat treatment step. In the tower use of temperatures ranging from 300° F. (~149° C.) to 600° F. (~315.5° C.) necessitate very short residence times. Generally, with temperatures of 500°-600° F., residence times of as little as 5 seconds in the tower and tangential separator are required to achieve maximum filling power increases. In such tower treatments, tobacco materials having 15 to 30%, and preferably 25%, moisture content are preferably employed.

Increases in filling power effected by means of the invention depend on the temperature, time and initial OV of the material being treated. Typically, raising the temperature necessitates reduced treatment times to maximize filling power increases for materials having similar initial OV's. On the other hand, higher initial OV's typically yield higher filling power increases at similar temperatures, but require longer treatment periods to maximize such increases.

Materials which have undergone the heat treatment process of the invention may then be processed according to conventional techniques to place them in condition for use in smoking articles. First, the heat treated material may be reordered to standard conditions without reversing the filling power increase. Relatively gentle reordering conditions are preferred. Such reordering can be effected by exposure to circulating air at 60 to 65% RH or to steam. Thereupon the treated product is in a condition permitting usual processing such as blending, after-cut application and smoking article manufacturing operations. Further, the treated reordered tobacco may be threshed or shredded after treatment without reversing the increase in filling power achieved during the process. Threshing refers to breaking up continuous sheet into relatively large irregular pieces.

The process of the present invention does not affect the specific volume of the reconstituted tobacco material to an appreciable extent. Further, microscopic examination of reconstituted tobacco treated in accordance with the process reveals no evidence of expansion. On the other hand, it is evident that the process of the invention increases the stiffness of the reconstituted tobacco. Such stiffening is apparently due to cross-linking within the tobacco as evidenced by shrinkage in surface area of the treated material, reduced equilibrium OV for the treated material relative to untreated material and stress relaxation tests.

It is thus postulated that the mechanism of the present process involves a molecular rearrangement of the tobacco as a result of which bonding, quite possibly covalent bonding, occurs within the tobacco. This bonding is in turn believed to be responsible for the stiffening and increased filling power.

The invention may be illustrated by the following examples. In these, the term $CV_R$ refers to cylinder volume of the untreated material corrected to the OV of the treated material by the following experimentally determined relationship:

$$CV_R = 63.63 - 3.259\,(OV) + 0.06387\,(OV)^2$$

The term Δ is the percentage increase of the cylinder volume of the treated material, CV, over $CV_R$ as defined above.

Cylinder volume measurements were determined using the method described in Wakeham et al., "Filling Volume of Cut Tobacco and Cigarette Hardness", *Tobacco Science* Vol. XX, pp. 157-60 (1976), the disclosures of which are incorporated herein by reference.

EXAMPLE 1

Cut filler prepared from reconstituted tobacco sheet prepared by a process such as described in German Patent 1,757,267 was brought to an OV content of approximately 42% by equilibration over water, and portions were heated in a circulating air oven at four temperatures ranging from 88° to 135° C. for 24 hours. The results were as follows:

| Treatment | Reordered | | $CV_R$ | |
|---|---|---|---|---|
| Temperature °C. | % OV | CV, cc/10 g | cc/10 g | Δ |
| 88 | 12.9 | 35.9 | 32.2 | 11.5 |
| 106 | 11.7 | 39.8 | 34.2 | 16.4 |
| 120 | 10.9 | 43.3 | 35.7 | 21.3 |
| 135 | 10.4 | 47.9 | 36.6 | 30.9 |

These results demonstrate that temperatures above about 120° C. are necessary even in this protracted treatment to produce significant (at least 20%) increase in cylinder volume.

EXAMPLE 2

Portions of cut filler of the type used in Example 1 were moisturized or dried and then heated in a circulating air oven at 135° C. for 24 hours and then reordered for 24 hours at 60% r/h, 24° C. Drying to intermediate levels, 9 or 4.4%, was by exposure over "Drierite" desiccant for an appropriate period. Complete drying was accomplished by freeze-drying, with initial freezing in liquid nitrogen followed by exposure to reduced pressure with no application of heat other than that from the environment. Measurements are set forth below.

| % Initial OV | Reordered % OV | Reordered CV, cc/10 g | $CV_R$ cc/10 g | Δ |
|---|---|---|---|---|
| 45.9 | 10.1 | 51.0 | 37.2 | 37.1 |
| 36.7 | 10.4 | 47.9 | 36.6 | 30.9 |
| 27.4 | 10.6 | 46.4 | 36.3 | 27.8 |
| 25.3 | 10.5 | 45.9 | 36.5 | 25.8 |
| 18.2 | 10.4 | 44.2 | 36.6 | 20.8 |
| 14.2 | 10.2 | 44.2 | 37.0 | 19.5 |
| 9.0 | 10.1 | 43.2 | 37.2 | 16.1 |
| 4.4 | 10.0 | 42.7 | 37.4 | 14.2 |
| 0[a] | 10.6 | 40.0 | 36.3 | 10.2 |
| 0[a,b] | 15.2 | 27.1 | 28.8 | −3.9 |

[a]freeze-dried
[b]not heated

It is clear that under these treatment conditions initial moisturization in excess of about 15% is ncessary to achieve a significant increase in filling power through the heating step.

EXAMPLE 3

Several samples of shredded reconstituted tobacco leaf prepared as in Example 1 were adjusted to various moisture contents, heated in an oven at 85° C. overnight, and then reordered at 76° F. and an RH of about 60%. The filling power of the treated samples is compared to that of untreated material below:

| OV Prior to Heating | Reordered OV | CV | $CV_R$ | Δ % |
|---|---|---|---|---|
| 8.6 | 12.8 | 33.0 | 32.4 | 2 |
| 17.5 | 13.2 | 33.9 | 31.7 | 7 |
| >40* | 13.8 | 34.9 | 30.8 | 13 |

*estimated value

EXAMPLE 4

Two samples of shredded reconstituted leaf prepared as in Example 1 were ordered by spraying to OV's of 17.4 and 36.3%, respectively. Portions of each sample were then put through a drying tower at temperatures of 600°, 500°, 400° and 300° F. (~315.5°, 260.0°, 204.4° and 149° C. respectively). An all steam atmosphere was used with a gas velocity of 130 feet/second. The residence times in the tower and tangential separator were on the order of 5 seconds. The results of these tests are summarized as follows:

HEAT TREATMENT IN DRYING TOWER

| Sample | T (°F.) | Exit OV | Reordered CV | Reordered OV |
|---|---|---|---|---|
| Starting Material | — | — | 34.3 | 13.8 |
| Input OV = 17.4% | 600 | 1.4 | 60.8 | 10.4 |
| | 500 | 1.3 | 44.7 | 12.0 |
| | 400 | 3.1 | 38.5 | 12.9 |
| | 300 | 9.0 | 36.1 | 13.8 |
| | Control[a] | — | 34.3 | 14.3 |
| Input OV = 36.3% | 600 | 2.1 | 48.8 | 12.2 |
| | 500 | 3.2 | 42.2 | 13.2 |
| | 400 | 9.9 | 38.9 | 13.7 |
| | 300 | 25.5 | 38.4 | 14.2 |
| | Control [a] | — | 35.0 | 14.2 |

[a]These samples were reordered from their respective input OVs to standard conditions without going through the tower.

These results indicate that with temperatures of 500°–600° F. increases of 30–80% in reordered CV can be achieved within five seconds. Further, the results show that samples having higher imput OV's give larger increases in reordered CV at any given exit OV. That is, high initial moisture content favors large CV increases.

The results further indicate that the rate of the process increases as the moisture content of the material drops in the tower. The sharpest increases occur after the exit OV is reduced to about 3%. This means that for a sample with a higher input OV, a longer residence time should be required to achieve the maximum effect simply because more water has to be removed. Consequently, at a given temperature and a sufficiently short residence time a sample with a lower input OV could show the larger increase as indicated by the data. For a sample with a higher input OV, one would thus use a higher gas temperature or a longer residence time.

EXAMPLE 5

A sample of shredded reconstituted tobacco leaf prepared as in Example 1 was sprayed to an OV of 29.3%. Portions were subjected to microwave radiation for 1, 2, 4, and 6 minutes, respectively. The samples were then ordered to standard conditions. Thereupon their CV values were determined. The results were as follows:

MICROWAVE HEAT TREATMENT

| Duration of Exposure* (minutes) | CV (cc/10g) | OV (percent) |
|---|---|---|
| 0 | 29.3 | 14.4 |
| 1 | 32.7 | 14.8 |
| 2 | 32.9 | 13.9 |
| 4 | 36.7 | 12.6 |

*9.45 GHz, power not known

The results indicate that small increases in CV were brought about by the microwave heating. The numbers under-estimate the potential magnitude of the effect because the heating was not homogeneous. The centers of the samples reached a much higher temperature than the peripheries. (The center of the 6-minute sample ignited.) The biggest CV increases would thus be found in the center of each sample. The above figures represent averages over the whole sample.

The results show that microwave heating will work. Microwave heating could be quite useful for treating sheet material which is not readily amenable to heat treatment in a tower.

EXAMPLE 6

A sample of threshed reconstituted tobacco leaf prepared as in Example 1 was ordered to an OV of 36.7% by equilibrating over distilled $H_2O$ and placed in a mechanical convection oven at 135° C. for 16 hours. At the end of this period, the material was dry and very brittle. This material was reordered with steam to a moisture content sufficient to make it pliable and was then shredded. A control consisting of a sample of untreated threshed reconstituted leaf prepared as above was also shredded. Both the treated and controlled samples were ordered to standard conditions. Thereafter the CV values of the samples were measured. The results were as follows:

| HEAT TREATMENT OF THRESHED SHEET | | |
|---|---|---|
| Sample | CV (cc/10g) | OV (%) |
| Control | 34.8 | 12.9 |
| Heat Treated | 54.5 | 11.3 |

These results indicate that filling power increase produced by the heat treatment process of the invention survives the shredding process.

EXAMPLE 7

In order to evaluate the mechanism of the present process samples were treated according to the process and subjected to various tests. The materials, test procedures and results were as follows:

(a) A sample of reconstituted tobacco leaf prepared as in Example 1 was sprayed to an OV of 42%. It was then divided into portions of equal size and placed in a mechanical convection oven at 150° C. Portions were taken out at regular time intervals. The samples were reordered to standard conditions before determining their CV values. The results were as follows:

| TIME DEPENDENCE OF HEAT TREATMENT IN AN OVEN AT 150° C. | | | |
|---|---|---|---|
| Heating Time (hours) | Reordered CV (cc/10g) | Reordered SV (cc/g) | Reordered OV (percent) |
| 110[a] | 30.1 | 0.94 | 16.3 |
| 1 | 37.8 | 0.80 | 12.0 |
| 2 | 43.0 | 0.77 | 10.3 |
| 3 | 46.4 | 0.78 | 10.0 |
| 4 | 49.3 | 0.80 | 9.8 |
| 5 | 53.5 | 0.74 | 9.8 |
| 6 | 55.1 | 0.77 | 9.8 |
| 7 | 59.2 | 0.78 | 9.6 |
| 16 | 63.2 | 0.76 | 9.4 |

[a]This sample was sprayed to an OV of 42% and reordered to standard conditions without heating.

A plot of the reordered CV's versus time indicates that CV increases in an exponential fashion and takes about 14 hours to go to completion. The present process is thus much too slow to be a water expansion which would hinge on the rapid vaporization of water. Further although the CV values increase with heating time, the specific volume (SV) of the reconstituted leaf as measured in acetone is essentially unaffected, whereas the SV can increase as much as 300–400% upon expansion.

(b) A sample of reconstituted tobacco leaf prepared as in Example 1 at an OV of 15.9% was divided into portions which were put through the drying tower at temperatures of 400°, 500°, and 600° F., respectively. An all-steam atmosphere was used in all cases but one. The gas velocity was 130 feet/second. The results were as follows:

| THE EFFECT OF THE DRYING TOWER ON SV | | | | | |
|---|---|---|---|---|---|
| Temperature (°F.) | Exit OV (percent) | Exit SV (cc/g) | CV (cc/10g) | Reordered SV (cc/g) | OV (percent) |
| 600[a] | 0.2 | 1.01 | 51.6 | 0.92 | 11.0 |
| 500[a] | 0.6 | 0.82 | 43.6 | 0.80 | 12.0 |
| 500[b] | 0.5 | 0.77 | 38.0 | 0.80 | 12.6 |
| 400[a] | 2.0 | 0.73 | 36.8 | 0.78 | 13.3 |

-continued

| THE EFFECT OF THE DRYING TOWER ON SV | | | | | |
|---|---|---|---|---|---|
| Temperature (°F.) | Exit OV (percent) | Exit SV (cc/g) | CV (cc/10g) | Reordered SV (cc/g) | OV (percent) |
| Control[c] | — | — | 32.8 | 0.81 | 15.9 |

[a]steam atmosphere
[b]air
[c]This sample was reordered from the input OV of 15.9% to standard conditions without going through the tower.

The data shows that the SV values were not significantly changed, although large increases in CV were obtained. Once again, this argues against expansion.

It is further noteworthy that the all-steam atmosphere was more effective than air, even though air does about as well as steam in water removal.

(c) Strips of reconstituted leaf tobacco prepared as in Example 1 and heat treated by adjusting the OV to 40% and heating in an oven at 135° C. were subjected to stress relaxation tests. Briefly, the test sample was clamped vertically at one end while the free end was flexed by a small anvil pressing normally to its surface at the contact point. After initial flexure, the deflection was kept constant while the restoring force on the anvil was measured as a function of time. At equal deflections and times, the restoring force before and after heat treatment provides the comparative measure of stiffness.

Six test strips were measured before and after heat treatment. It was found that the restoring force was increased by a factor of 1.5 to 1.8 after heat treatment. Thus, the basic stiffness of the reconstituted tobacco was increased by the heat treatment.

A change in the stiffness of a material could be the result of geometric changes, such as sample thickness fiber orientation, or of basic changes at the molecular level within the material. Cross-linking would increase the stiffness of a material via the second mechanism. Geometric changes would primarily be reflected in the amplitude of the relaxation process. Changes at the molecular level within the material would affect primarily the time dependence of the relaxation process, a measure of which is provided by the normalized slope, $dF/F_1 d\ln t$ = normalized slope, where F is the restoring force, $F_1$ is the restoring force at unit time (1 minute), and t is time.

One would expect cross-linking to reduce the normalized slope. It was found for the 6 test strips that the normalized slope was reduced by a factor of 0.6 to 0.8 by the heat treatment. Thus, the stress relaxation data is consistent with a cross-linking mechanism.

(d) Examination of the test strips of subpart (c) revealed that heat treatment caused some wrinkling and distortion, as well as a shrinkage of roughly 9% in surface area. The shrinkage is consistent with cross-linking.

Microscopic examination with magnifications up to 500X revealed no changes in the nature of the surfaces of the strips after heat treatment. Certainly, no microscopic evidence for expansion was found.

What is claimed is:

1. A method of increasing the filling power of reconstituted tobacco made by a paper-making process which comprises:

(a) uniformly adjusting the moisture content of the reconstituted tobacco to between 15% and 50% by weight;

(b) subjecting the moisturized reconstituted tobacco to heat treatment for a period of time in excess of that required to accomplish evaporation of substantially all of the moisture in the reconstituted tobacco to stiffen the reconstituted tobacco, thereby increasing its filling power at a substantially constant specific volume.

2. The method of claim 1 wherein the process is effected on shredded reconstituted tobacco.

3. The method of claim 1 wherein the process is effected on reconstituted tobacco sheet.

4. The method of claim 1 wherein step (a) comprises spraying the tobacco with water and thereafter bulking the tobacco until uniformly moisturized.

5. The method of claim 4 wherein a warm water spray is employed.

6. The method of claim 1 wherein the heat treatment is effected in a convection oven.

7. The method of claim 6 wherein step (b) is effected at a temperature between 120°–150° C.

8. The method of claim 7 wherein the heat treatment is effected for 8–24 hours.

9. The method of claim 6 wherein the moisture content of the tobacco is adjusted to 20–50%.

10. The method of claim 6 wherein the moisture content of the tobacco is adjusted to about 40%.

11. The method of claim 7 wherein the heat treatment is effected in a drying tower.

12. The method of claim 11 wherein the step (b) is effected at a temperature between 500° to 600° F.

13. The method of claim 12 wherein the heat treatment is effected for about 5 seconds.

14. The method of claim 12 wherein the moisture content of the tobacco is adjusted to 15–30%.

15. The method of claim 11 wherein the moisture content of the tobacco is adjusted to about 25%.

16. The method of claim 11 wherein an unsaturated steam atmosphere is employed in the tower.

17. The method of claim 1 wherein the reconstituted tobacco contains no binder.

18. The method of claim 1 including the further step: (c) reordering the stiffened reconstituted tobacco.

* * * * *